US007154072B2

(12) United States Patent
Sherrill et al.

(10) Patent No.: US 7,154,072 B2
(45) Date of Patent: Dec. 26, 2006

(54) METHOD OF USING OPEN COIL RESISTANCE HEATER IN APPLIANCES WITH RIGHT AND LEFT HAND INSTALLATION CAPABILITY

(75) Inventors: James L. Sherrill, Cookeville, TN (US); H. Keith Howard, Cookeville, TN (US)

(73) Assignee: Tutco, Inc., Cookeville, TN (US)

( * ) Notice: Subject to any disclaimer, the term of this patent is extended or adjusted under 35 U.S.C. 154(b) by 0 days.

(21) Appl. No.: 11/002,671

(22) Filed: Dec. 3, 2004

(65) Prior Publication Data

US 2006/0118545 A1 Jun. 8, 2006

(51) Int. Cl.

| | |
|---|---|
| ***H05B 3/06*** | (2006.01) |
| ***H05B 3/08*** | (2006.01) |
| ***H05B 3/16*** | (2006.01) |
| ***F24D 5/10*** | (2006.01) |

(52) U.S. Cl. ..... 219/532; 219/536; 219/537; 219/541; 219/552; 219/478; 392/350

(58) Field of Classification Search ..... 219/536, 219/537, 532, 539, 541, 552, 477, 478; 392/350
See application file for complete search history.

(56) References Cited

U.S. PATENT DOCUMENTS

| | | | | |
|---|---|---|---|---|
| 3,016,441 | A * | 1/1962 | Hackman et al. | 219/532 |
| 3,631,525 | A * | 12/1971 | Brasch | 392/350 |
| 3,794,810 | A * | 2/1974 | Brasch et al. | 392/350 |
| 3,811,031 | A * | 5/1974 | McBride et al. | 392/350 |
| 3,889,392 | A * | 6/1975 | Davis et al. | 34/82 |
| 4,268,742 | A * | 5/1981 | Cottrell et al. | 219/532 |
| 4,628,190 | A * | 12/1986 | Sherrill | 219/532 |
| 4,857,707 | A * | 8/1989 | Dall | 392/485 |
| 5,329,098 | A * | 7/1994 | Howard et al. | 219/532 |
| 5,925,273 | A * | 7/1999 | Sherrill | 219/478 |
| 6,190,163 | B1 * | 2/2001 | Maricic et al. | 431/354 |
| 6,478,577 | B1 * | 11/2002 | Maricic et al. | 431/353 |
| 6,545,251 | B1 * | 4/2003 | Allera et al. | 219/394 |
| 6,593,553 | B1 * | 7/2003 | Whitfield | 219/536 |
| 6,723,968 | B1 * | 4/2004 | Danko et al. | 219/536 |
| 2003/0089701 | A1 * | 5/2003 | Sherrill | 219/536 |
| 2004/0262293 | A1 * | 12/2004 | Riddle et al. | 219/497 |
| 2005/0047763 | A1 * | 3/2005 | Nawrot et al. | 392/350 |

* cited by examiner

*Primary Examiner*—Robin O. Evans
*Assistant Examiner*—Stephen J. Ralis
(74) *Attorney, Agent, or Firm*—Clark & Brody

(57) ABSTRACT

An open coil resistance heater assembly is made for universal mounting between left and right hand installations in an appliance or other equipment. The heater assembly has its coils arranged symmetrically about a bisecting plane of the heater assembly and/or a center line of its terminal assembly aligned with the bisecting plane. The symmetrical coil arrangement and/or bisected terminal assembly allow the heater to be used in right hand or left hand installations.

2 Claims, 6 Drawing Sheets

METHOD OF USING OPEN COIL RESISTANCE HEATER IN APPLIANCES WITH RIGHT AND LEFT HAND INSTALLATION CAPABILITY

FIELD OF THE INVENTION

The present invention is directed to an open coil electric resistance heater, and in particular, to a heater that can be mounted in an appliance in right hand or left hand installations.

BACKGROUND ART

The use of open coil heaters, either as single stage or multistage arrangements, is well known in the industry. Generally, these heaters comprise one or more resistance wire heating coils, insulators to electrically isolate and support the coils on a plate or frame, ductwork to create a flow channel for forced air to flow over the coils for heating, and a termination assembly wherein the ends of the coil are linked to a source of power.

One example of this art is demonstrated in U.S. Pat. No. 4,268,742 to Cottrell et al. and U.S. Pat. No. 5,329,098 to Howard et al., herein incorporated in their entirety by reference. Other examples are demonstrated by product literature published by TUTCO, Inc. of Cookeville, Tenn.

One significant aspect of open coil heater art is that of mounting heaters into metal ducts. The prior art for heaters mounted into heater ducts is limited to single position mounting of the termination and heater support ceramics. This is because rotating the heater 180° about the axis of the heater duct will change the relationship of one or more of the heater coils, the support ceramics or the heater termination so that a temperature sensing devices will not operate properly in the rotated position. Another feature is that in some designs the heater orientation can only be in one position because movement of the heater coil due to gravity during heating has been accounted for in one direction only.

Another prior concept of mounting heaters into ductwork is that of attaching the heater structure in such a manner as to ensure the heater is affixed to the ductwork. In the prior art either fasteners, tabs, tensioning spring clips or some combination of these are used. Fasteners and tensioning spring clips are well known and an example of a tab mounting technique that requires no fasteners can be found in U.S. Pat. No. 5,895,597 to Sherrill, also incorporated by reference herein in its entirety. The tab mounting shown in this patent permits expansion and contraction of the mounting plate due to thermal cycling. It should be also noted that the heater support plate and termination assembly in this heater are mounted in only one of the duct halves. This arrangement precludes the heater's use in another installation due to the location of the terminal block on the one duct half.

In the prior art for multi-stage heaters, electric coil ends reaching from the heated sections to the element terminals must span distances that expose the wires to potential grounding or contact with electrically live parts. Such exposure requires electrical isolation of these transition sections. Isolation is accomplished by ceramic tubes as disclosed in U.S. Pat. No. 5,925,273 to Sherrill or by special standoff insulators defined in U.S. application Ser. No. 10/879,286 to Howard et al., each owned by the present assignee, Tutco, Inc.

In the prior art for single stage heaters, the use of a coil configuration to position the single open coil element on both sides of a metal mounting plate can be found in the above-referenced U.S. Pat. No. 4,268,742. This art demonstrates a FIG. 8 coil path configuration.

One common application for single or multistage open coil resistance wire heaters is for installation as part of other heating equipment or appliances, e.g., clothes dryers. The manufacturer of appliances and equipment, especially a clothes dryer manufacturer, often requires multi-stage open coil electric heaters mounted in a heater duct. Prior art multi-stage heaters are designed to be operated in a given position within the duct. Termination components, wherein the resistance wire coils straighten to form lead wires for connection to a terminal assembly, heater support insulators or ceramics, and over temperature limit controls are set in precise locations in these types of equipment.

In certain applications, appliances are needed that are commonly called left-hand and right-hand mounting. That is, certain heater components like the termination assembly, limit controls and the like may be located on one side of the heater in one installation, and required to be located on the other side of the heater in another installation. When an appliance is designed with a multi-stage open coil electric heater mounted in a duct, maintaining the left hand-right hand heater and heater duct relationship requires two heater designs. This is because in the prior art, heaters are designed only for one orientation whereby one heating assembly is used for a right hand connection and another heating assembly would have to be used for the left hand assembly.

Because of this two heater design requirement, a burden is imposed on the appliance maker and heater manufacture, thereby increasing the costs for both parties. As such, there is a need in the industry for a heater design concept that will permit a single heater to be used in left-hand or right-hand heater duct orientations. The present invention satisfies this need by providing a single heater assembly design equally adapted for left and right hand installations.

SUMMARY OF THE INVENTION

It is a first object of the invention to provide an improved open coil resistance heater.

It is another object of the invention to provide an open coil resistance heater that can be used in either right hand or left hand installations.

Yet another object of the invention is a heater component as a support plate for insulators and one or more resistance wire coils that has right hand or left hand installation capability by reason of its symmetric termination assembly mounting.

One other object is a method of using the heater of the invention, wherein its rotation between left and right hand orientations allows for use in different heater environments.

Other objects and advantages will become apparent as a description of the invention proceeds.

The invention, as an improvement in open coil electric heaters, in one mode involves a special mounting of the terminal block of a termination assembly to permit right or left handed use. The heater assembly comprises a frame, and preferably a plate, which defines a first plane, the frame having a plurality of insulators mounted to it. At least one resistance wire coil is mounted to the frame via a plurality of insulators, the coil being ultimately powered to supply heat for the heater's intended purpose. A duct joined to and surrounding the frame defines a flow channel to direct air across the coil. The duct, the plurality of insulators, the frame, and the at least one resistance wire coil form a heater structure having a plane that bisects the heater structure transversely.

The heater structure also includes at least one terminal assembly with a terminal block mounted on the heater structure on one of the opposing sides thereof. A centerline of the terminal block is aligned with the bisecting plane of the frame to form a first installation orientation. A second installation orientation is defined by rotation of the heater structure 180 degrees from the first installation orientation such that the centerline of the terminal block in the second installation orientation is still aligned with the bisecting plane. This allows the heater structure to be mounted to appliances requiring first or second installation orientations.

Another embodiment of the invention allowing right and left hand installation involves symmetric alignment of the coil with the heater structure. In this embodiment, the terminal block is mounted at a connection location on the heater structure on one of the opposing sides to define a first installation orientation, but this mounting does not have to align with the heater bisecting plane as in the first mode, although it could if so desired. Minor adjustment can be made with terminal connections during installation in the second orientation if the terminal block centerline does not match the heater bisecting plane.

Importantly though, the resistance wire coil is mounted above and below the frame to form a symmetric coil configuration with respect to the frame and the bisecting plane of the heater structure. With this configuration, the resistance wire coil is positioned in the same way in both of the installation orientations, thereby allowing the heater and coils to function properly in either orientation.

While the terminal block can be mounted anywhere on the heater structure, it is preferred to mount it to the frame or duct, or a combination of both if more than one terminal block is used. One or a plurality of terminal blocks can be mounted to the heater structure. Similarly, the heater structure can employ more than one resistance coil to form a two stage or multiple stage heating apparatus. The heater structure can utilize a unitary duct structure, or the heater can be formed with duct halves that are adapted to join with the frame and define the bisecting plane for right and left handed installations. When using duct halves, the terminal block could be mounted to one half, or if multiple blocks are employed, the blocks could be mounted to one or both halves. The terminal block or blocks can use any number of terminals for connection purposes.

The invention also includes the heater subassembly without the duct, wherein the terminal block would be mounted to the frame in the proper alignment for use in left or right handed installations.

In yet another embodiment, the invention comprises the use of a number of heater assemblies, wherein the heater assemblies can be used in multiple appliances wherein the same heater assembly is used in a first appliance with a left hand orientation, and another heater of the same type is rotated for use in an appliance having a right hand orientation.

BRIEF DESCRIPTION OF THE DRAWINGS

Reference is now made to the drawings of the invention wherein.

DESCRIPTION OF THE PREFERRED EMBODIMENTS

Figure 1:
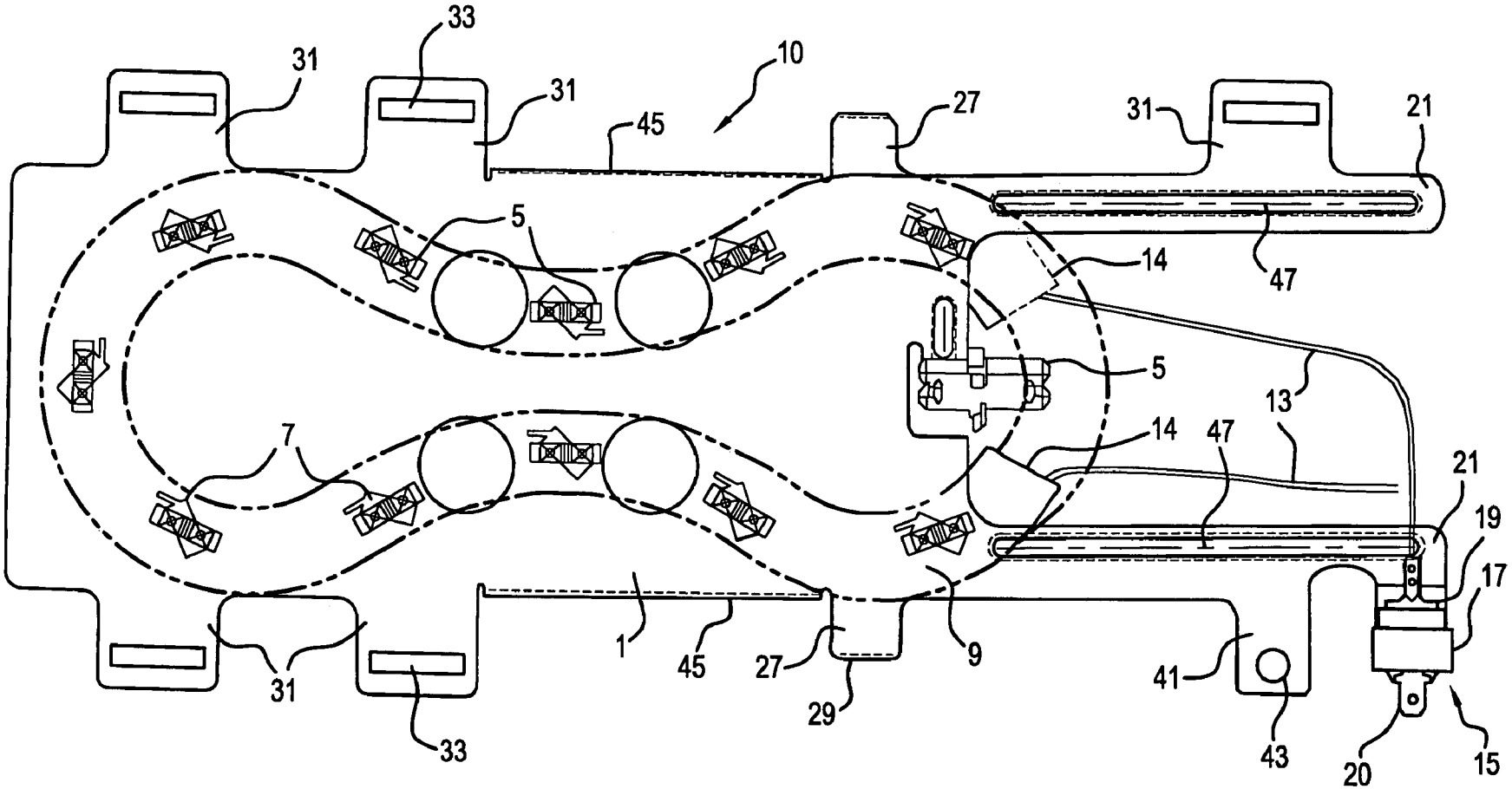
FIG. 1 is top view of a heater subassembly employing a single coil and a terminal assembly mounted to the plate.

The invention offers significant advantages in the field of open coil resistance heaters by eliminating the need for separate heater designs to accommodate different installation orientations for the heater assembly. In contrast to the prior art designs, wherein a given heater assembly could only be installed in one way, the present invention allows the same heater assembly to be installed in different orientations, e.g., a right handed or a left handed installation. These installations can be described principally by the connection location of the termination assembly of the heater. For any given installation, the heater assembly takes on a particular orientation, e.g., the right hand, so that power can be supplied to the heater assembly via the termination assembly. In certain appliances, a second orientation is required, wherein the heater assembly connection for power is in an opposing location, e.g., the left hand orientation, such that the connection to power is at 180 degrees from the power connection in the right hand orientation.

In one mode of the invention, the right and left orientations are achieved by arranging the terminal assembly, including the terminal block on the heater assembly so that it can occupy opposing positions with respect to the heater assembly, and be used for right hand or left hand installations, depending on the heater assembly rotation. More particularly, the heater assembly is defined by a heater frame, and more particularly a support plate, a plurality of insulators mounted to the frame, and one or more resistance wire coils mounted to the insulators. Ductwork, either as a single duct or duct halves, is joined to the frame to form a heater assembly. A termination assembly which comprises one or more terminal blocks, each having one or more poles (terminals) associated with it is mounted to one or more of the ductwork or the frame on one side of the heater assembly. The mounting of the terminal assembly is done to coincide or align with a plane that bisects the heater assembly. In this way, the position of the terminal assembly still bisects the plane transversely when the heater assembly is rotated 180 degrees, and terminal block connection to an ultimate source of power via wiring or the like can be made in either the right or the left handed orientation. In this regard, the heater coil should be arranged so that it functions in either installation as well.

In another aspect of the invention, the heater coil mounted to the frame is mounted with respect to the frame so that it is symmetrical about the bisecting plane. This puts the coil in the same configuration no matter what the orientation of the heater assembly, and thus the coil can function adequately in right or left handed installations. By mounting the coil so that it is symmetric about the frame, and aligning the support plate with the bisecting plane of the heater assembly, the problems that may occur due to coil movement due to gravity are not aggravated in either heater assembly orientation. The coil can function the same whether the heater assembly is oriented for right or left hand installation. In this mode, the terminal assembly could be also aligned with the bisecting plane as well. However, the invention includes the mode, wherein just the coils are symmetric and there may be a slight deviation in the terminal assembly alignment with the bisecting plane that would have to be accounted for during the installation. While it is preferred to have the coils and terminal assembly be aligned with the bisecting plane, just one or the other could be aligned to still meet the right or left hand installation, albeit not as effectively, since some adjustment may be required for power connection to the terminal assembly or coil mounting.

It should be understood that the special mounting of the coils covers both single stage and multistage heater assemblies. Likewise, the special mounting of the terminal assembly can involve one or more terminal blocks, and the terminal block or blocks could be mounted to either the frame or the ductwork, or a combination thereof.

Figure 2:
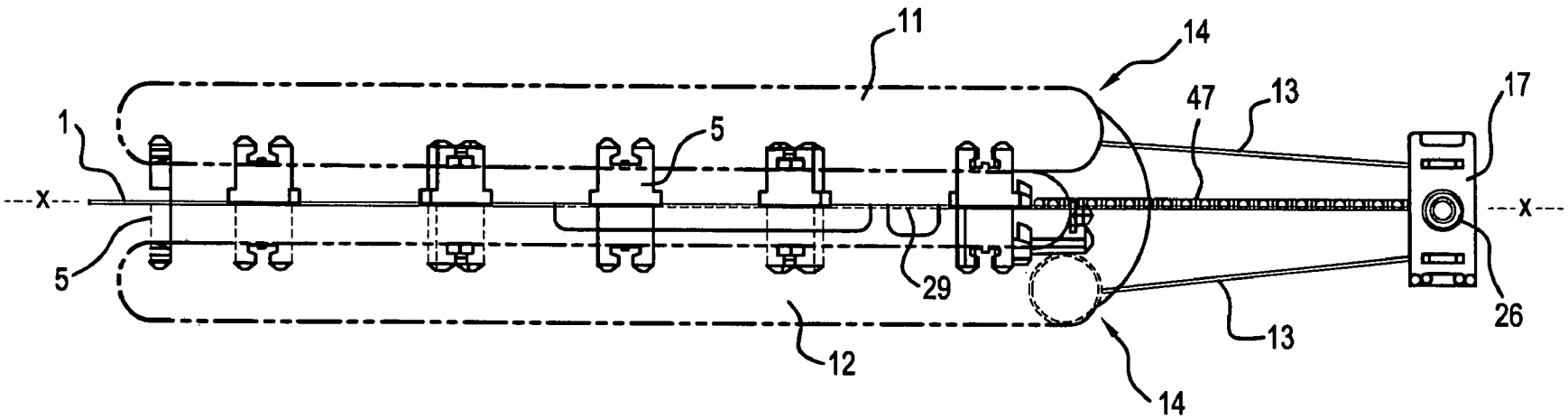
FIG. 2 is a side elevational view of the heater subassembly of FIG. 1.
Figure 3:
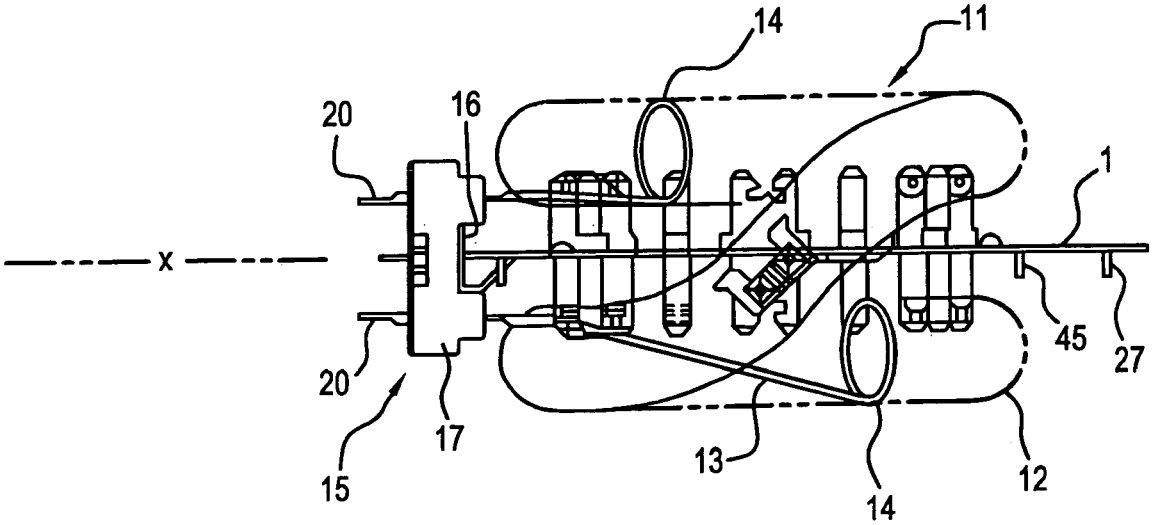
FIG. 3 is an end elevational view of the heater subassembly of FIG. 1.

Referring now to FIGS. 1–3, one embodiment of a heater subassembly of the invention is designated by the reference numeral 10 and illustrates a heater support plate 1. The heater subassembly 10 combines with ductwork (not shown) to form a channel for air flow around the heating coils. The support plate 1 has mounted thereto a plurality of insulators 5. The insulators are adapted to mount to the plate 1 via openings 7 in the plate, whereby each insulator is positioned in the opening and then rotated for securement purposes. Since this type of attachment is well known, a further description is not required for understanding of the invention.

A single resistance wire coil 9, in an exemplary figure eight configuration, is shown for forming a single stage heater assembly. A portion 11 of the coil 9 is mounted above the plate 1, and a portion 12 mounted below the plate 1. The coil terminates in a pair of lead wires 13, each lead wire extending from a respective coil end 14 to a terminal assembly 15. The terminal assembly 15 of this embodiment comprises a terminal block 17, and pair of terminals 19. This terminal assembly is commonly referred to as a two pole terminal block by virtue of the pair of terminals 19. The lead wires 13 are attached to the terminals 19 in conventional fashion, with the free terminal ends 20 adapted to be connected to source of power (not shown) via components of the equipment supporting the heater assembly.

Referring particularly to FIGS. 2 and 3, it can be seen that the coils ends 14 and coil portions 11 and 12 are arranged symmetrically about the plate 1, whereby the plate defines a plane on line "X". The centerline of the terminal block 17 also coincides with a plane X of the plate 1. In FIG. 3, the heater subassembly 10 is shown in a left hand orientation whereby the terminal ends 20 would align with connectors linked to power supply components in a given piece of equipment, e.g., a clothes dryer. Because of the alignment of the centerline of the terminal block 17 with the support plate 1 and heater structure, if the heater support plate assembly 10 is rotated 180 degrees to the right in FIG. 3, the terminal assembly 15 is still aligned with the plane of the support plate 1, and can be connected to power supply components of the equipment in this right hand orientation. Therefore, the heater support plate 1 of FIGS. 1–3 can be used to at least two different types of equipment, e.g., clothes dryers requiring terminal assembly connection in two different locations. While a support plate 1 is depicted, other shapes as a frame to support the coils can be utilized, providing that the frame allows for maintaining the terminal assembly and/or coils to be symmetric with the heater assembly plane to permit the dual use for different appliance orientations.

The terminal assembly 15 is mounted to one of two extension arms 21 of the plate 1. The mounting is attained by having a flange 16 arranged perpendicularly to the plate 1 (see FIG. 3), the flange 16 having an opening (not shown) that can receive a fastener extending through a bore in the terminal block 17 for attachment purposes. The other extension 21 is used as part of interfacing the support plate 1 with a duct to form the heater assembly. While the mounting is shown using a fastener and flange, mounting can be done in any conventional fashion.

The plate 1 is adapted to connect to a duct or duct halves with maximum allowance for expansion. To achieve this in the embodiment of FIG. 1, the plate includes a pair of arms 27, each arm having a tab 29 extending at a right angle from the end of the arm. The tab 29 is designed to fill a slot in one duct half as discussed below. The plate also has a plurality of arms 31 with slots 33 therein. The slots 33 are designed to interface with tabs of another duct half forming the channel for air flow. The described interfacing of the heater support plate 1 with ductwork is exemplary, and other configurations that allow the heater support plate and ductwork to form a completed heater assembly can be employed.

The support plate also has a mounting tab 41 extending from one of the arms 21. The mounting tab 41 has an opening 43 which is designed to align with an opening in the duct as discussed below so that a fastener can be employed to link the duct and support plate 1 together. In a preferred embodiment, a single fastener is employed to maximize the ability of the duct and support plate of the heater assembly to move relative to each other during expansion and contraction caused by heat up and cool down. Of course, more than one fastener attachment point could be used if so desired.

For structural rigidity of the plate support 1, tabs 45 can be formed as part of the plate 1 if so desired. Other rigidity enhancing features such as the raised portions 47 on the arms 21 can also be utilized.

Figure 4A:
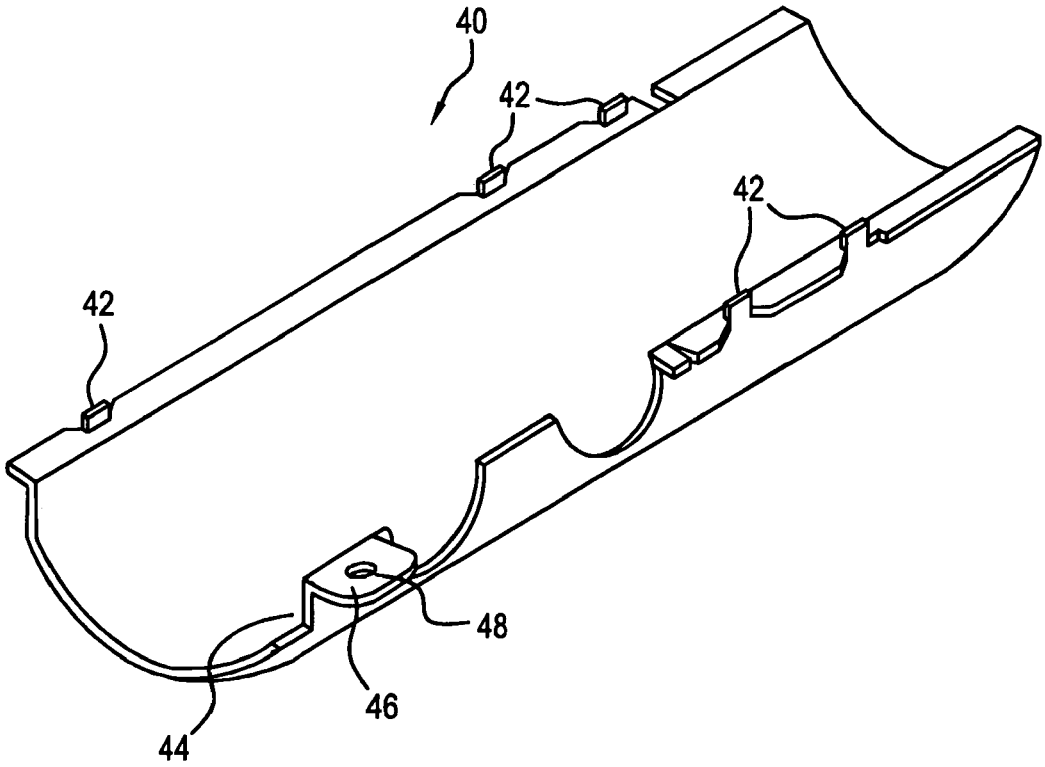
FIG. 4A is a perspective view of an exemplary duct half of a heater assembly.

FIG. 4A shows an exemplary duct half designated by the reference numeral 40. The duct halve is generally u-shaped, with tabs 42 designed to interface with slots 33 of the plate 1. The duct half 40 also has a cutout 44 to accommodate the terminal block 17 and an arm 46 and opening 48 to interface with arm 41 and opening 43 on the support plate, see FIG. 1, to allow for duct half and support plate fastening. Although not shown, another duct half would have a pair of slots to interface with tabs 29 of the plate 1, and have other slots to receive tabs 42 of the other duct half. In this arrangement, the tabs 42 would extend through the slots 33 in the support plate 1 and enter slots in the duct half. This mutual tab/slot engagement between the plate and duct halves keeps the duct halves and plates together while still allowing relative movement between each other to accommodate the expansion and contraction of the metal that occurs during heating.

While duct halves are shown to form the heater assembly, it should be understood that a single duct could also be employed with the appropriate features to interface with a support plate to form the heater assembly. For example, a single duct could be employed having a slit along one side to allow insertion of the plate, with spaced apart openings on the other side of the duct engaging arms of the plate, similar to the attachment described in the Sherrill patent discussed above. If using a single duct, it should be understood that the interfacing of the duct and support plate would vary from that disclosed, and the interfacing could take on any configurations that would allow relative movement between the plate and the duct, while still maintaining their mutual integrity as a heater assembly, e.g., the use of tabs and slots or other loose engaging arrangements, coupled with one or more fastening arrangements. In yet another alternative, the duct and support plate could loosely interface with each other without a fastening attachment if so desired.

Figure 4B:
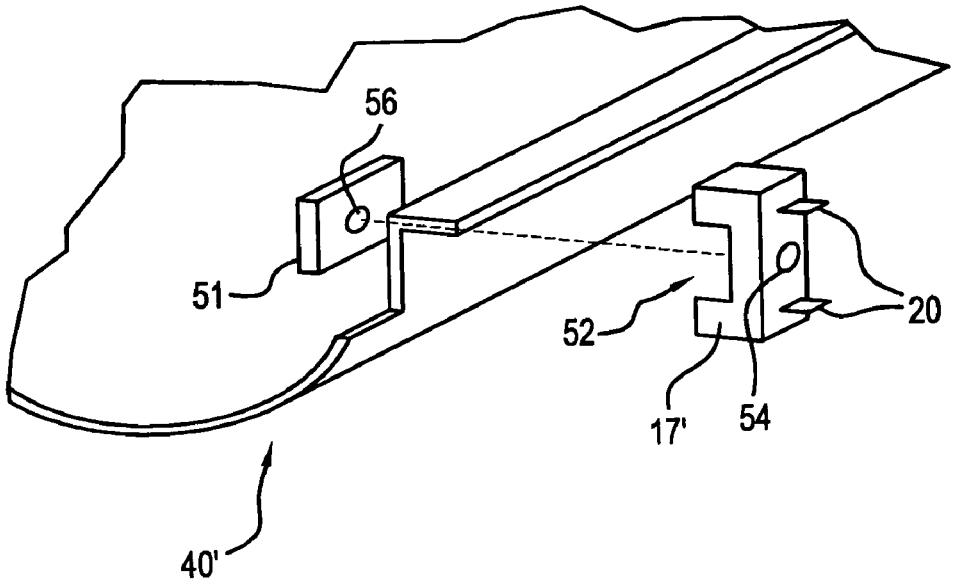
FIG. 4B is a section of an alternative duct half design showing a terminal mounted to the duct half.

As mentioned above, another embodiment of the invention is to mount the terminal block 17 to the duct half instead of the support plate, thereby eliminating the need for the extension arm altogether. One housing half designated as reference numeral 40' can be adapted by designing a mounting tab extension 51, see FIG. 4B, to accept the two pole terminal block 17' and retain its centered location relative to the heater assembly centerline, thereby allowing the duct to be rotated 180 degrees and still have the centerline of terminal block 17' align with the bisecting or centerline plane of the heater assembly. In FIG. 4B, the ends of the terminal opposite free ends 20 of the terminal block 17' would be attached to the element wire ends 13. The heater support plate without the termination assembly would be placed in the duct half with the terminal block mounted to the duct, and the terminals appropriately attached to the terminal block. The second duct half (not shown), would be suitably adapted to accept the terminal block(s) as located in the first duct half, and would be mated with the first duct half and coil-containing heater support plate to form the heating assembly. FIG. 4B also more clearly shows the recess 52 in block 17' with the block through hole 54 aligning with the hole 56 in the mounting tab 51 for attachment.

Figure 5:
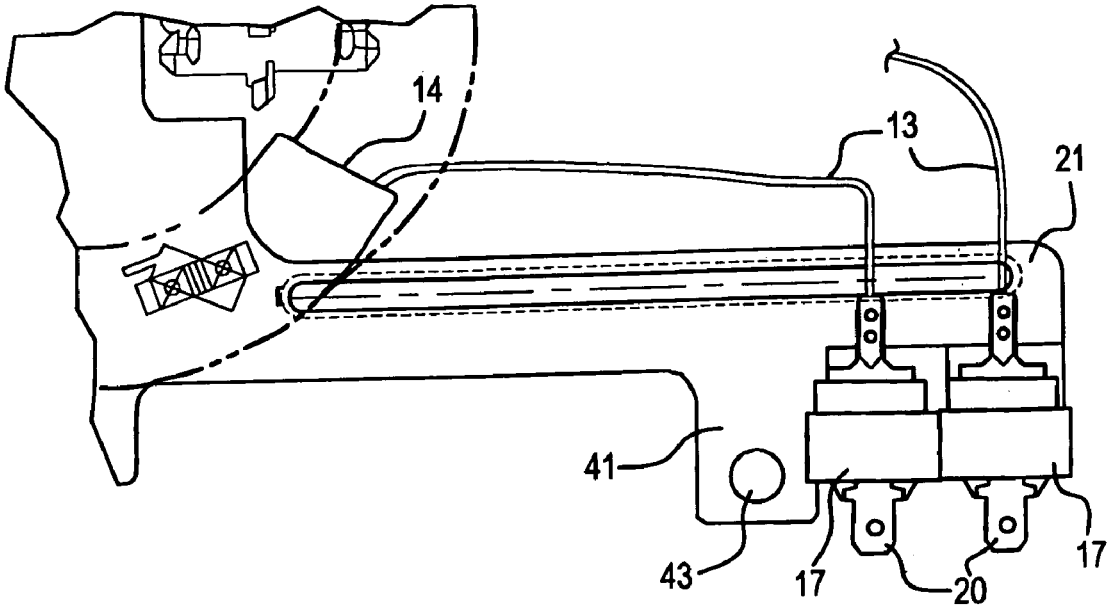
FIG. 5 is a top view of a portion of a heater subassembly showing a multiple terminal assembly mounting.

As also mentioned above, one other embodiment of the invention is the use of multiple terminal blocks either attached to the support plate 1, or a duct, or one or more duct halves. Referring to FIG. 5, the arm 21 of the support plate 1 of FIG. 1 is shown with a pair of two pole terminal blocks 17, thus creating a four pole terminal connection. While these blocks are shown in a side-by-side configuration, blocks could be arranged in spaced apart or stacked configurations as well. Other multiple terminal block arrangements could be used as well.

A further embodiment for eliminating the terminal block extension arm when two terminal blocks are used is to mount one block in each half duct with the opposite duct half designed to accept the terminal block arrangement of the other. This arrangement would be similar to that shown in FIG. 4B, just that each duct half would support a terminal block, with the respective mountings being arranged so that when the duct halves are put together, the terminal assemblies are aligned with a bisecting plane of the thus-formed duct Attaching the final terminal(s) to the terminal block will be more difficult in this embodiment but can be accomplished as the final step for assembly of the heater-heater duct is made.

A further feature of the invention is the manner in which the support plate 1 can interface with duct halves. Referring again to FIG. 1, the special mounting arms 31 extending from each side of the heater support plate can interface with depressions made in mating flanges formed on each of the two sides of the two heater duct halves (not shown). The depressions may be located either in both halves or in only one half. Either mating depressions can be formed in opposing flanges or one depression of sufficient depth can be made on one flange of one duct half with no depression at the corresponding point on the mating flange. The depressions and mating flanges should be arranged so that either or both of the coil arrangement and the terminal assembly are aligned with the heater assembly bisecting plane.

Figure 6:
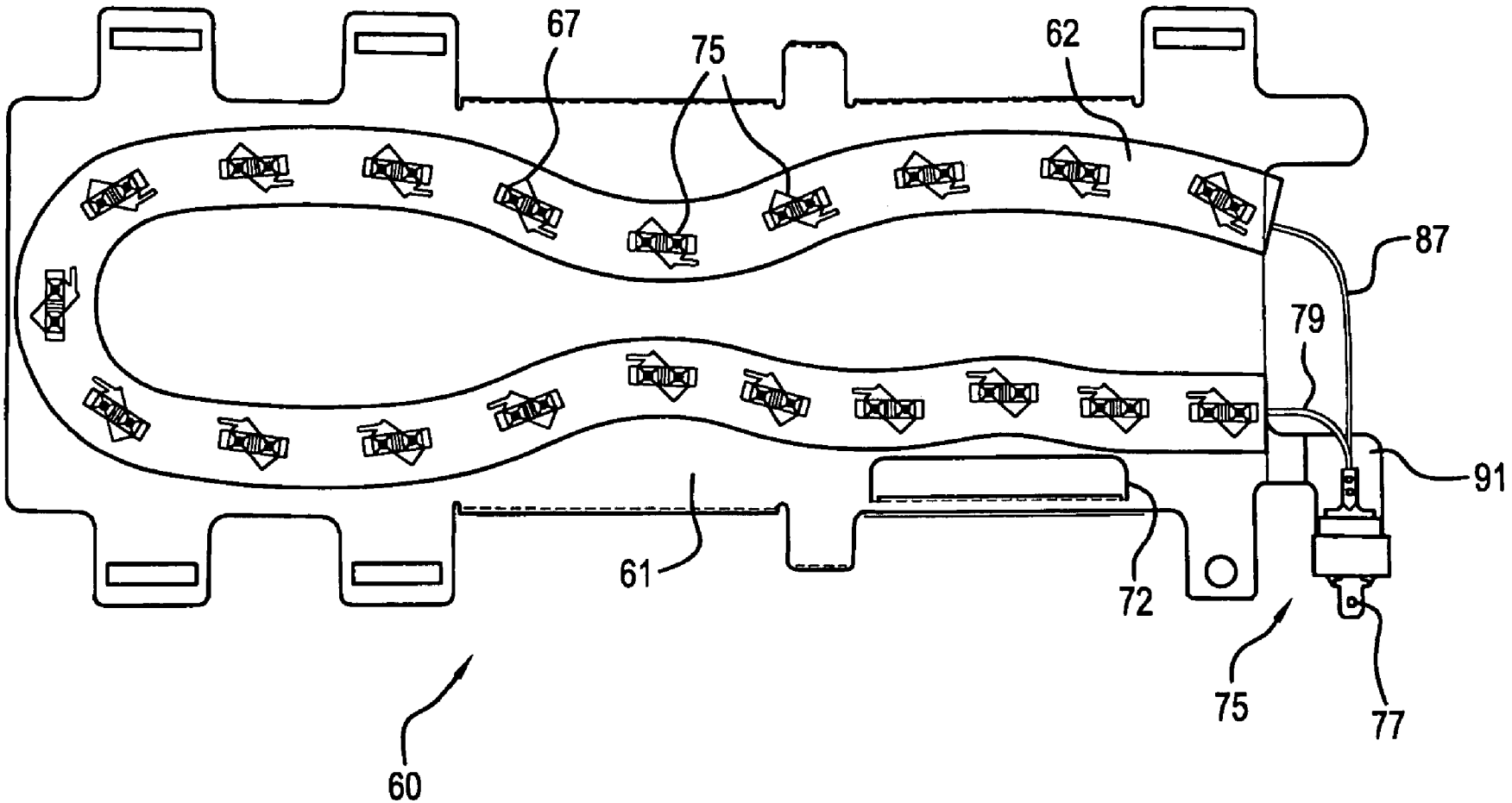
FIG. 6 is top view of a heater subassembly employing two coils and a terminal assembly mounted to the plate.
Figure 7:
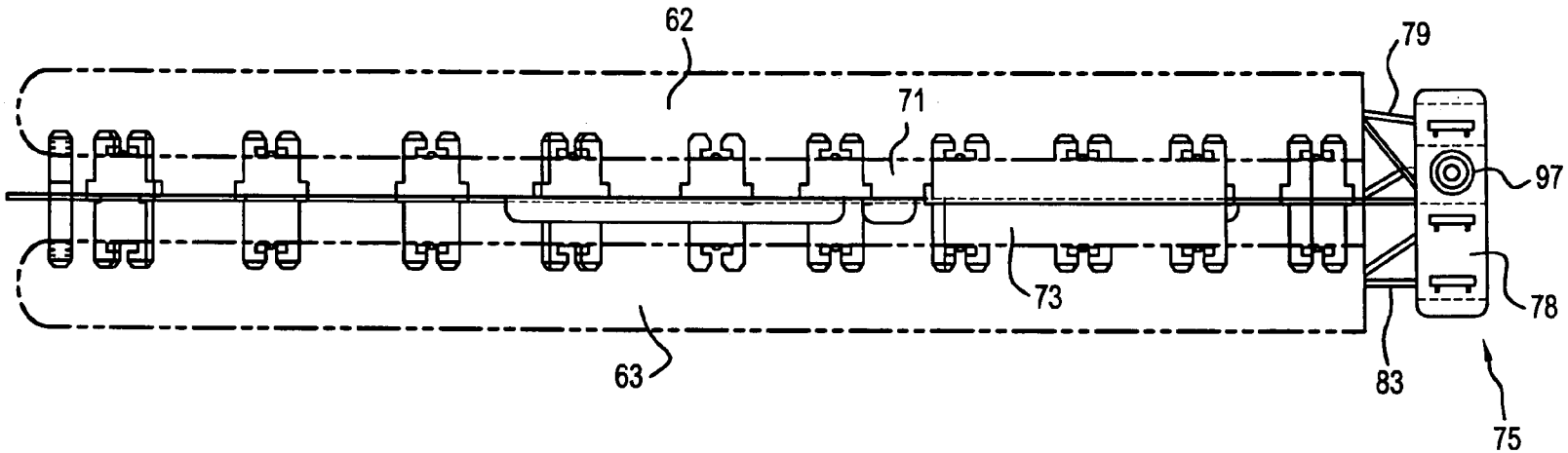
FIG. 7 is a side elevational view of the heater subassembly of FIG. 6.
Figure 8:
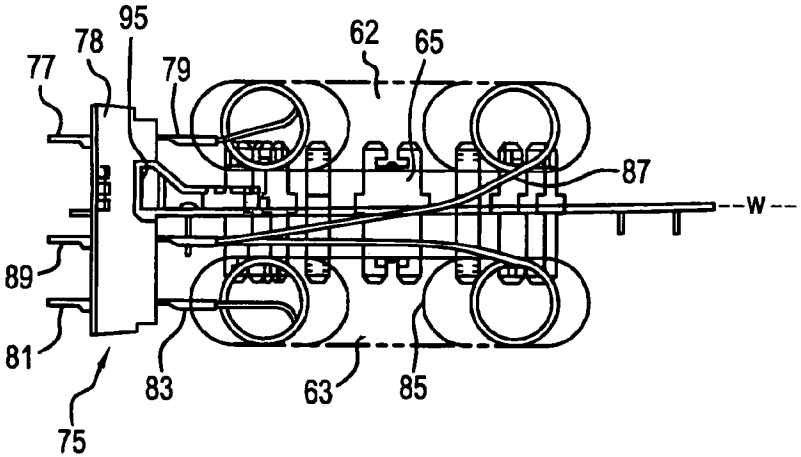
FIG. 8 is an end elevational view of the heater subassembly of FIG. 6.

FIGS. 6–8 illustrate another embodiment of the invention, wherein a two stage heater is employed and a heater subassembly is designated by the reference numeral 60. The subassembly includes a support plate 61 having a pair of coils 62 and 63 mounted thereon via insulators 65 and the appropriate openings 67 in the plate 61. One coil 62 is mounted on one side of the plate 61 with the other coil 63 mounted on the other side.

The support plate 61 has the same features as support plate 1 in terms of mounting to ductwork, and a further description of this is not deemed necessary for understanding of this embodiment.

Unlike the FIG. 1 embodiment, the support plate 61 includes a pair of heat shields 71 and 73 that are positioned to protect controls (not shown), such as thermostats and thermal cutoff switches that are mounted to the heater assembly. Because of the heat shield, the coil 62 takes on a skewed FIG. 8 configuration. In certain applications though, the heat shields may be optional, and the coils could have a FIG. 8 configuration if so desired. In fact, other configurations of the coils can be utilized as are known in the art.

The heater subassembly of FIGS. 6–8 employs a three pole terminal assembly 75 with terminal block 78. One terminal 77 connects to the lead wire 79 of the coil 62 with another terminal 81 connecting to the lead wire 83 of the coil 63. The remaining two lead wires 85 and 87 of coils 62 and 63, respectively, connect to the middle terminal 89. The terminal assembly 75 is mounted to the support plate 61 in the same fashion as for FIG. 1, an extension arm 91 is provided that is configured at its end with a plate 95 perpendicular to the plane of the plate 61 for attachment purposes using a fastener 97.

While the FIGS. 1 and 6 embodiments show two and three pole terminal assemblies, any type of termination assembly arrangement can be utilized as part of the invention. As an example, a pair of single pole blocks can be used to make a two pole arrangement, a single pole block and a two pole block can be employed to form a three pole embodiment, and three single pole terminal blocks could be used to form a three pole arrangement.

Referring to FIG. 8, it should be noted that the three poles 77, 81, and 89 are not all symmetric about the plane "W" of the heater, just poles 77 and 81 are. However, the centerline of the block 78 is still aligned with the plane W. Thus, when rotating the heater assembly from the left hand orientation shown in FIG. 8 to a right hand orientation position, slight adjustment for connection to terminal 89 may be required depending on the equipment using the heater assembly.

As with the single stage heater subassembly of FIGS. 1–3, the embodiment of FIGS. 6–8 can also employ multiple terminal assemblies, and interface with a single duct or duct halves to form a heater assembly. Likewise, the duct or duct halves could support the terminal assembly or one or all of the multiple assemblies if so desired.

Another feature of the embodiment shown in FIGS. 6–8 is the absence of long lead wire runs and thus the absence of any need to use insulators to support the runs as is done in other prior art designs. As best seen in FIG. 6, each of the runs of lead wires 79 and 87 is relatively short.

Figure 9:
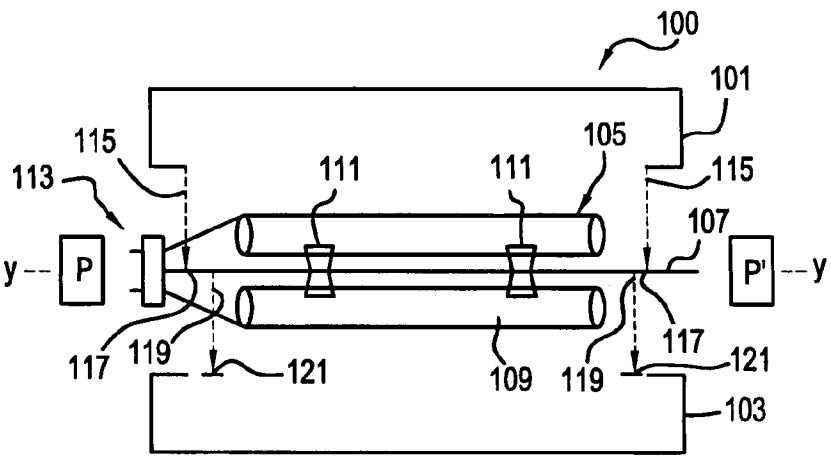
FIG. 9 is a schematic representation of a heater assembly using a heater subassembly and a pair of duct halves.

FIG. 9 is provided to show schematically a completed heater assembly designated by the reference numeral 100. The assembly 100 is shown with duct halves 101 and 103 and the heater subassembly 105. The subassembly has a plate 107, coil 109 supported by insulators 111, and a terminal assembly 113. Tabs 115 of duct half 101 engage slots 117 in plate 107, with tabs 119 in plate 107 engaging slots 121 in duct half 103. As can been seen from this configuration, the terminal assembly 113 is mounted so its centerline coincides with the plane "Y" of the heater plate as measured laterally or transversely. The duct halves are configured so that when they are joined with the plate 107 to form the heater assembly, the plane "Y" of the plate 107 coincides with a bisecting plane of the thus-formed heater assembly 100. The heater assembly 100 can be connected with the terminal assembly in the position shown in FIG. 9 to connect to a component (designated by P) of an appliance or other equipment adapted to supply power to the heater assembly. The heater assembly 100 could be rotated 180 degrees so that the terminal assembly 113 is still aligned with the plane "Y" and could connect to another power source component P', positioned in the same manner as component P, albeit in an opposing location. Thus, the same heater assembly 100 can be used in two different pieces of equipment, one requiring a right hand installation orientation and one requiring a left hand installation orientation wherein the component adapted to bring power to the heater assembly in the left hand orientation is in an opposing position as compared to the right hand installation orientation. In FIG. 9, the plate 107 and coil 109 are mounted in a symmetric fashion about the plane of the plate. However, it could be that just the coil is mounted symmetrically or just the terminal assembly (either mounted to the plate or one of the duct halves could have its centerline on the centerline of the heater assembly).

Without the features of this invention, to have heaters located on both the left and the right side of appliances require two heaters with position sensitive design. With the inventive heater design, the number of heater models required to support manufacturing are cut in half when compared to the prior art. Also the electrical connection to power, consideration for coil movement due to gravity during heating and the temperature safety limits do not have to be special for left and right hand duct mounting since every feature of the heater is identical, relative to gravity, whether left hand or right hand mounted.

As such, an invention has been disclosed in terms of preferred embodiments thereof which fulfills each and every one of the objects of the present invention as set forth above and provides a new and improved open coil resistance heater capable of right hand and left hand installations, and its method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a method of installing at least two heater assemblies in at least first and second appliances, wherein a first appliance has a first component for supplying power to the heater assembly located in a right hand orientation, and a second appliance has a second component for supplying power to the heater assembly located in a left hand orientation opposed from the right hand orientation, the improvement comprising installing the heater assembly in both the first and second appliances, wherein the heater assembly further comprises a frame having a plurality of insulators mounted to it, the frame having means for joining to a duct, at least one resistance wire coil mounted to the frame via the plurality of insulators, and at least one terminal block mounted on the frame on one of the opposing sides thereof, a centerline of the terminal block aligned with a plane of the frame to form a first installation orientation, a second installation orientation defined by rotation of the frame 180 degrees from the first installation orientation, the mounting of the terminal block and the joining means configured to maintain the centerline of the terminal block in alignment with the plane in the second installation orientation to allow the heater assembly to be mounted to appliances having the first or second installation orientations.

2. In a method of installing at least two heater assemblies in at least first and second appliances, wherein a first appliance has a first component for supplying power to the heater assembly located in a right hand orientation, and a second appliance has a second component for supplying power to the heater assembly located in a left hand orientation opposed from the right hand orientation, the improvement comprising installing the heater assembly in both the first and second appliances, wherein the heater assembly further comprises a frame having a plurality of insulators mounted to it, a duct, and means for joining the frame to the duct, at least one resistance wire coil mounted to the frame via the plurality of insulators, and at least one terminal block mounted on the duct on one side thereof, a centerline of the terminal block aligned with a bisecting plane of the duct to form a first installation orientation, a second installation orientation defined by rotation of the heater 180 degrees from the first installation orientation, the terminal block being mounted to the duct in such a way to maintain the centerline of the terminal block in alignment with the bisecting plane in the second installation orientation to allow the heater structure to be mounted to appliances having the first or second installation orientations.

* * * * *

UNITED STATES PATENT AND TRADEMARK OFFICE

CERTIFICATE OF CORRECTION

PATENT NO. : 7,154,072 B2
APPLICATION NO. : 11/002671
DATED : December 26, 2006
INVENTOR(S) : Sherrill et al.

It is certified that error appears in the above-identified patent and that said Letters Patent is hereby corrected as shown below:

On the Title Page, Item -56-

Under References Cited, U.S. Patent Documents, included should be 4,481,411 11/1984 Roth Signed and Sealed this Fifteenth Day of April, 2008

JON W. DUDAS
*Director of the United States Patent and Trademark Office*